US006167666B1

(12) United States Patent
Kelly

(10) Patent No.: US 6,167,666 B1
(45) Date of Patent: Jan. 2, 2001

(54) EARLY WARNING LEAK DETECTOR

(76) Inventor: Thomas L. Kelly, 31 Sands St., Waterbury, CT (US) 06710

( * ) Notice: Under 35 U.S.C. 154(b), the term of this patent shall be extended for 0 days.

(21) Appl. No.: 09/132,805

(22) Filed: Aug. 13, 1998

Related U.S. Application Data

(63) Continuation-in-part of application No. 09/067,325, filed on Apr. 27, 1998, now abandoned.

(51) Int. Cl.[7] ..... E04F 17/00
(52) U.S. Cl. ..... 52/302.1; 52/741.4; 52/DIG. 12
(58) Field of Search ..... 52/302.1, 302.6, 52/741.1, 741.3, 741.4, DIG. 12

(56) References Cited

U.S. PATENT DOCUMENTS

| | | | | |
|---|---|---|---|---|
| 3,710,942 | * | 1/1973 | Rosenberg | 210/136 |
| 3,941,149 | * | 3/1976 | Mittleman | 137/493.1 |
| 3,967,197 | * | 6/1976 | Anderson | 324/664 |
| 4,110,945 | * | 9/1978 | Sheahan | 52/173.1 |
| 4,317,996 | * | 3/1982 | Davis | 250/302 |
| 4,535,819 | * | 8/1985 | Atkinson et al. | 137/846 |
| 4,633,899 | * | 1/1987 | Lord | 52/DIG. 12 X |
| 5,117,597 | * | 6/1992 | Feller | 52/302.1 X |
| 5,212,927 | * | 5/1993 | Sheahan | 52/741.4 |
| 5,317,852 | * | 6/1994 | Howland | 52/302.1 X |
| 5,735,091 | * | 4/1998 | Hawkins et al. | 52/302.6 X |

* cited by examiner

*Primary Examiner*—Carl D. Friedman
*Assistant Examiner*—Kevin D. Wilkens
(74) *Attorney, Agent, or Firm*—Cantor Colburn LLP

(57) ABSTRACT

An early warning leak detector. The early warning leak detector is placed in a hole is formed in the sealed deck of a roof. The early warning leak detector has an exterior shell having a nipple for connecting the early warning leak detector to a hose. Located within the exterior shell is a one way valve. The one way valve allows water to pass through the early warning leak detector while maintaining any negative pressure between the roof deck and the roof membrane.

8 Claims, 5 Drawing Sheets

EARLY WARNING LEAK DETECTOR

This is a Continuation-In-Part application of U.S. Ser. No. 09/067,375, filed Apr. 27, 1998, entitled EARLY WARNING LEAK DETECTOR, now abandoned.

BACKGROUND OF THE INVENTION

1. Field of the Invention

The invention relates generally to roof leak detection systems and in particular to an early warning leak detector that indicates the presence of a leak before substantial roof damage occurs.

2. Prior Art

Leaks in a roof are typically not detected until a significant amount of damage has occurred. FIG. 1 is a cross-sectional view of a conventional roofing system. A substrate comprising of a sealed deck or substrate 10 or existing roof membrane. An insulation board 12 and a waterproof membrane 14 are positioned above the sealed substrate 10. If a leak develops in the roof, water gathers above the sealed substrate 10. Because the substrate 10 is sealed and water does not readily migrate therethrough, a building occupant will not be afforded an opportunity to apprehend that a roof failure has occurred. More particularly, the water leaking through the upper roof structure will be caught atop the sealed substrate and could puddle or even pond thereon for a long period of time. When failure of the substrate finally (and inevitably) occurs, a significant volume of water is available to do damage inside the building. Significant damage will also have been done to the roof material and structure during the time water was trapped above the sealed substrate. At this point a simple re-roofing job is not adequate; wet insulation is heavy and has virtually no insulative value. The existing roof must be torn off and the damage repaired. This takes place at large expense and could have been avoided if the building occupant were provided with a means to become aware of the roof failure earlier and before the destruction has magnified.

SUMMARY OF THE INVENTION

The above-discussed and other drawbacks and deficiencies of the prior art are overcome or alleviated by the early warning leak detector of the invention. The early warning leak detector provides a simple and effective means by which a building occupant will become aware of a leak situation rapidly and before extensive, possibly irreparable damage results. The leak detector provides a through substrate pathway for water to migrate should water work its way through the upper roof structure. The pathway is connectable to a one way valve or a drain hose. While the valve is connected, a leak (generally small initially) will cause a drip that will no doubt be noticeable by someone within the building. Once notice is taken of the problem further drippage can be avoided simply and easily by detaching the one-way valve from the water pathway and attaching in its place a hose having an outlet directed to a suitable drain site. In another embodiment of the invention, the valve remains in place and a hose is provided a connection site independent of the position of the valve. Knowledge being had of the leak, a repair may be effected.

It is important to understand for purposes of this disclosure that the term sealed substrate may be a new structure that has been air sealed in some way or a new structure inherently air sealed or an existing roof being re-roofed where the existing roof will act as the sealed substrate.

BRIEF DESCRIPTION OF THE DRAWINGS

Referring now to the drawings wherein like elements are numbered alike in the several FIGURES.

DETAILED DESCRIPTION OF THE INVENTION

Figure 1:
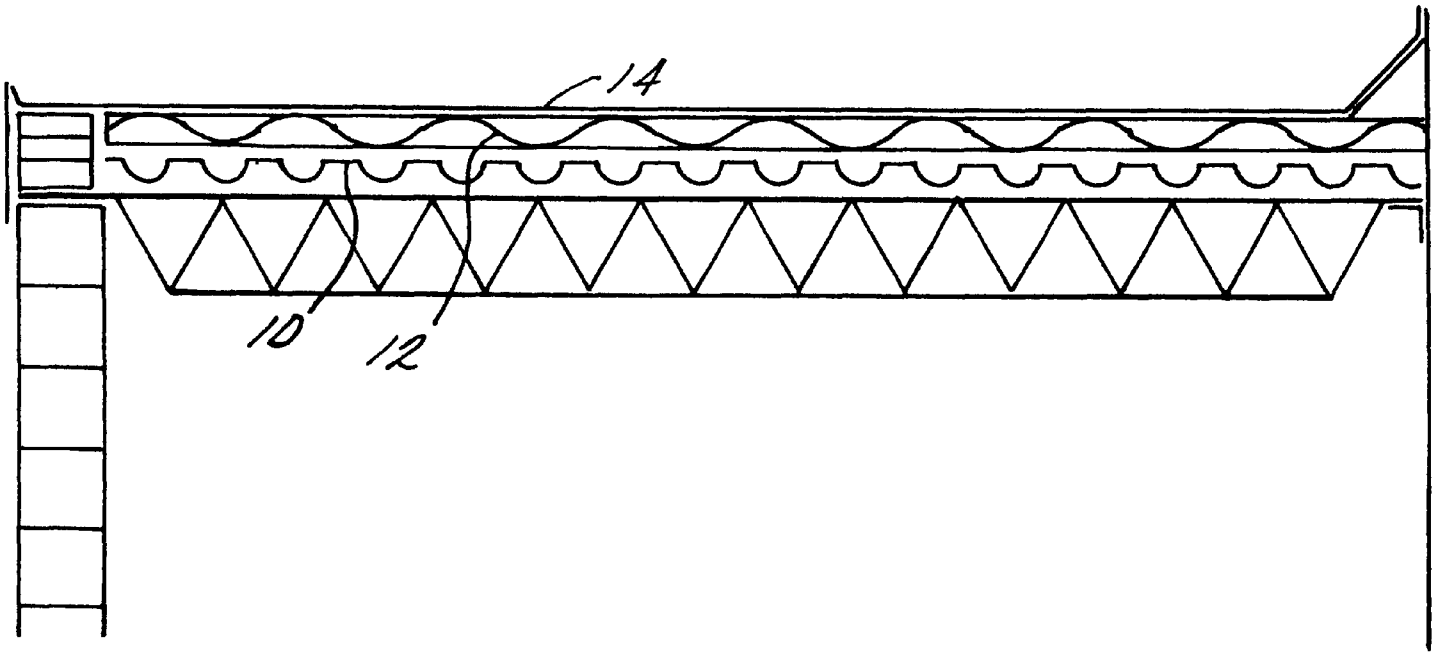
FIG. 1 (PRIOR ART)
FIG. 1 is a cross-section of a conventional roof.
Figure 1A:
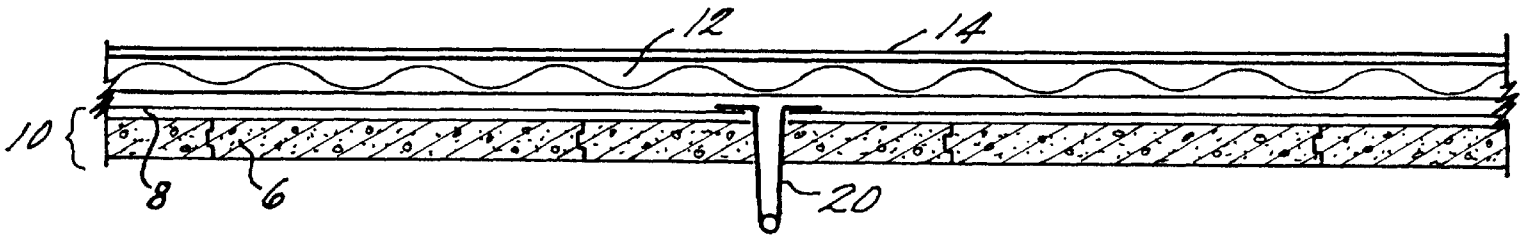
FIG. 1A is a cross-sectional view of a sealed substrate and roof structure with a leak detector of the invention installed and a re-roof assembly.

FIG. 1A is an illustration of the portion of the leak detector of the invention on (through) a sealed substrate in a new construction. The sealed substrate may be of any conventional type such as poured concrete or a panel construction which is air sealed by a sealant. In the figure substrate 10 is composed of panels 6 with an adhered membrane 8 thereover. These are followed by insulation 12 and a loose laid membrane 14. The leak detector 20 is illustrated extending through substrate 10 and into the building cavity which is located beneath panels 6.

Figure 1B:
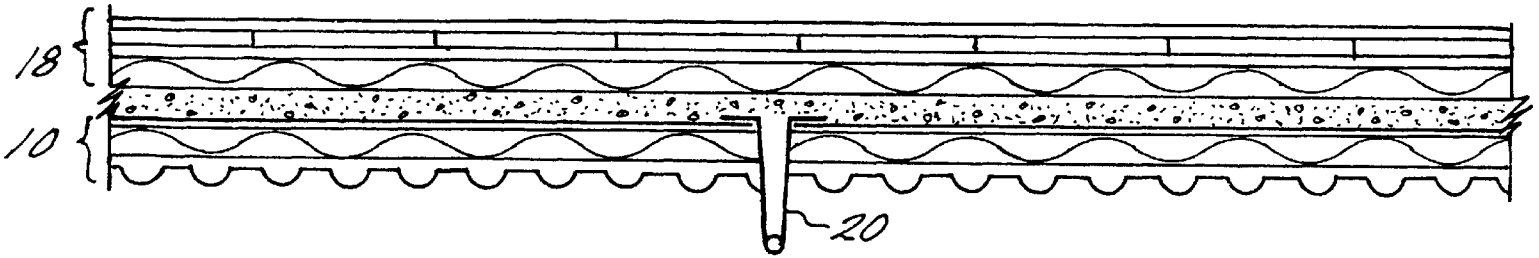
FIG. 1B is an illustration of a re-roofed construction wherein the leak detector is installed through the prior built-up roof construction.

FIG. 1B is an illustration of a re-roofed construction where the sealed substrate 10 is a built up roof (BUR) from a prior construction. A new roof is constructed atop the BUR and is identified in bulk as 18 because the type of re-roof is not material to the invention. In this embodiment the leak detector 20 is placed entirely through the original roof and into the building canty therebelow. The detector 20 is adhered to what was once the top layer of a preexisting roof.

Figure 2A:
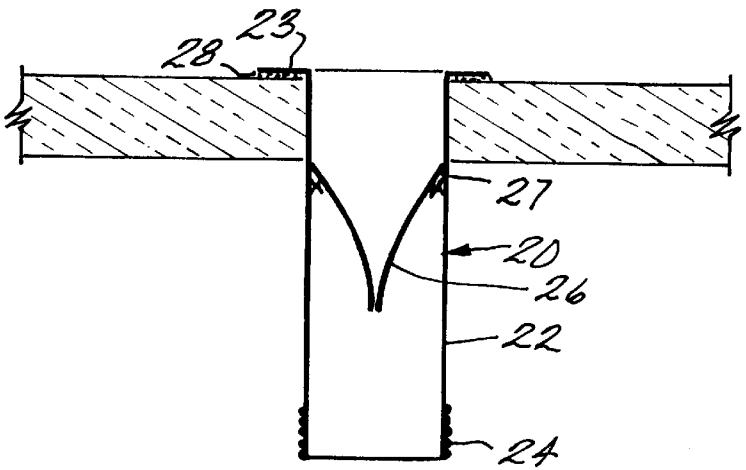
FIG. 2A is a schematic cross-sectional view of another embodiment of the leak detector of the invention.
Figure 2:
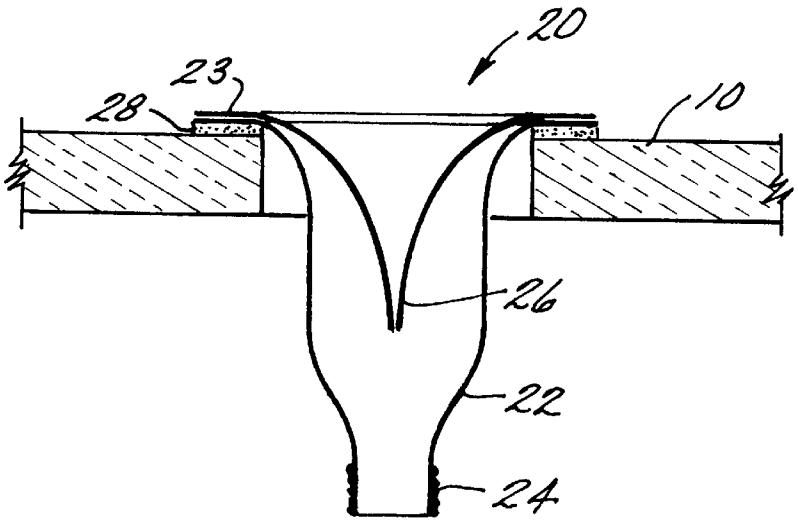
FIG. 2 is a schematic cross-sectional view of the early warning leak detector of the invention.

FIG. 2 is a cross-sectional view of an early warning leak detector embodiment of the invention shown generally at 20 installed in the sealed substrate 10. The substrate is sealed to prevent infiltration of air from the interior of the building to the underside of the waterproofing membrane of the roof. A hole is formed in the sealed substrate 10 for receiving an embodiment of an early warning leak detector 20 of the invention. The detector is preferably placed in a "low spot" on the substrate so that water naturally would collect above the detector enabling it to be detected.

In one embodiment of the invention the early warning leak detector 20 includes an exterior shell 22 defining a water passage conduit made from a waterproof material such as metal, rubber or plastic. Other embodiments may be as simple as a length of tubing with a mounting flange 23 at the top end thereof and a nipple 24 at the other end thereof (see FIG. 2A). The exterior shell 22 in this embodiment has a frustoconical shape although it should be noted that a cylindrical or other shape is substitutable. At one end of the exterior shell 22 is a nipple 24 for receiving a hose. The hose is intended to be connected when a leak has been detected by someone so that any leaking water is shunted to a safe location. Generally, a roof failure will occur slowly and the water collecting will be small. Thus, the hose will easily remove what water does accumulate.

To assist installation and sealing of detector 20, the exterior shell 22 includes a flange 23 that rests on the top surface of the sealed substrate 10 to which said flange is adhesively secured, preferably. The flange 23 has an outer dimension greater than the dimension of the hole formed in the substrate 10 so that the adhesive is provided a good bonding surface. The adhesive is preferably waterproof caulk or adhesive 28.

Important to all of the embodiments of the early warning leak detector 20 of the invention is a one way valve 26 located within the exterior shell 22 or at the end thereof. It should be understood by one of ordinary skill in the art in the type of roof where the substrate is sealed, that it is important to not allow air to leak into the roof. Thus, the one way valve is important to maintaining the seal. The one way valve 26 illustrated is a duckbill, flexible type valve, however it is understood that a variety of one way valves may be used. In an exemplary embodiment, the one way valve 26 is made from rubber. The one way valve 26 is joined to the exterior shell 22 near flange 23. Water on the sealed substrate 10 may easily pass through the one way valve 26 while air is not permitted to pass in the opposite direction (i.e. into the roof structure) thus contributing to a low air pressure within the roof structure (desirable). The one way valve 26 is connected to the flange 23 through a waterproof adhesive 27, a heat sealing process, and/or other suitable attachment methods.

As is known in the art, it is desirable to produce a low ambient air pressure between the roof membrane 14 and the sealed substrate so that the membrane 14 is drawn towards the insulation 12. Wind uplift resistance in such a roof structure is improved. U.S. Pat. No. 4,223,486 discusses the advantages of maintaining the membrane in contact with the insulation, and is incorporated herein by reference.

Figure 3:
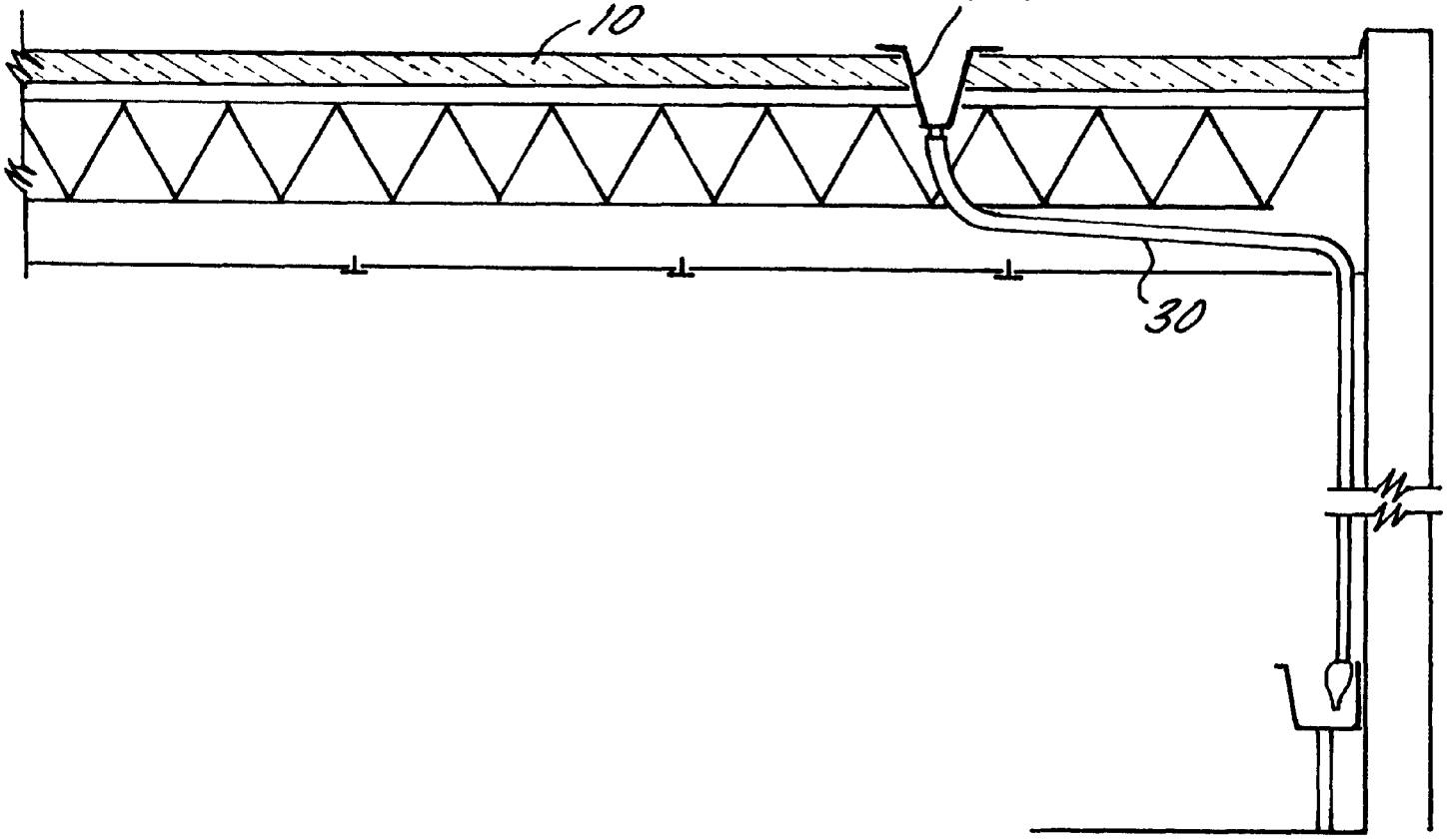
FIG. 3 is a schematic cross-sectional view of the early warning leak detector connected to a hose and extended to a sink.
Figure 4:
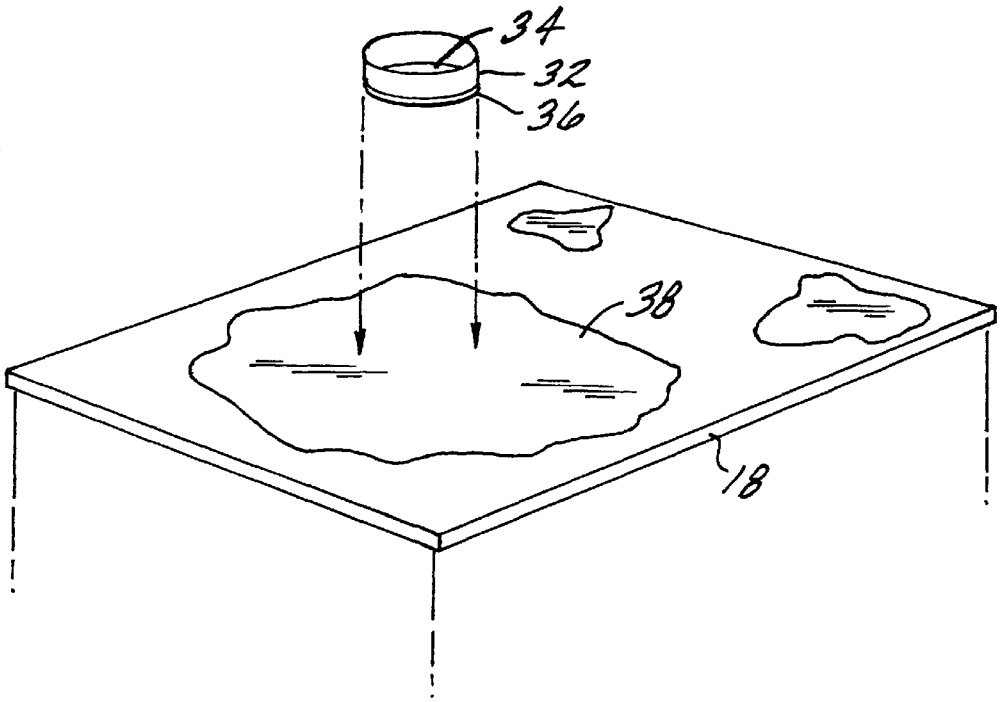
FIGS. 4 and 5 are sequential views of a water displacement structure above ponded water (FIG. 4) and in the water (FIG. 5) displacing the same.
Figure 5:
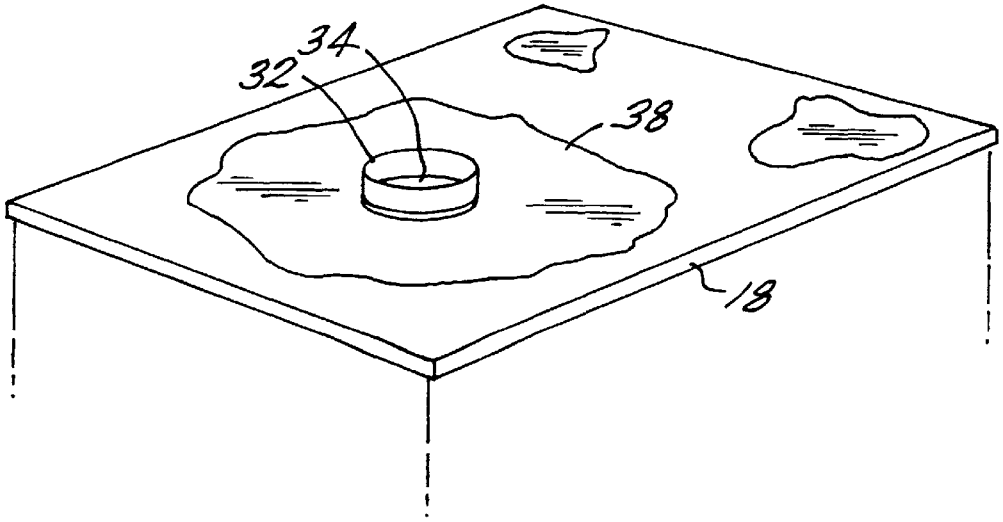

With the invention installed, a leak in the roof waterproofing membrane or other portion of the roof structure is easily detectable within the building by a drip emanating from the detector 20. It should also be noted that a water sensor with alarm may be positioned proximate the detector outlet if desired. If a leak is detected, the building occupant can attach a hose 30 to the nipple 24 and divert the water from the roof as shown in FIG. 3.

The present invention provides an inexpensive early warning leak detector that allows the occupant of a building to realize that a leak exists in the roof before substantial roof damage occurs. The early warning leak detector also preserves the negative air pressure between the sealed deck and the membrane which increases the wind uplift resistance of the roof.

Installation of the detector of the invention on a new roof is clear to one of skill in the art from the foregoing however the inventor hereof has also discovered a method for installing the detector on an existing roof where water is already ponding. It should be understood that the following method for installing the leak detector is also particularly suited to draining roofs which require construction of some kind. In the method of the invention an area of gravel on a roof is cleared away and a structure such as a 55 gallon drum 32 (portion thereof of about 6 inches in height) with the closed bottom 34 oriented downwardly and the open end oriented upwardly is used. A waterproof adhesive 36 is applied to the closed bottom 34 portion and the structure is urged into the standing water 38. The structure displaces water similar to the way a boat does and leaves a relatively dry area under the structure. Removal of the closed bottom 34 thereof, then, allows access to the roof without removing all of the standing water. The access allows one to install a leak detector as described herein which in this method is employed as a drain which can then easily remove the standing water.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A roofing system comprising:

a sealed substrate having a hole formed therein;

a waterproof membrane positioned above said sealed substrate;

an early warning leak detector having an exterior shell and a flange extending radially outwardly from said shell, said flange having an adhesive placed on a planar surface thereof and attaching said flange to said sealed substrate within said hole, said leak detector further including a one way valve positioned within said shell.

2. A roofing system of claim 1 wherein the sealed substrate is a water resistant layer above a roof deck.

3. The roofing system of claim 1 wherein said exterior shell comprises a nipple for connecting the early warning leak detector to a hose.

4. The roofing system of claim 1 wherein said one way valve is connected to said exterior shell.

5. A commercial roof early warning leak detector comprising:

an external shell having a first end and a second end and an interior surface and an exterior surface, said interior surface defining a water passage conduit;

a flange attached to said exterior surface of said shell proximate said first end and extending radially outwardly and substantially perpendicularly from said exterior surface;

a one way valve lacking an external closure bias mounted to said interior surface proximate said second end allowing easy fluid movement in a direction from said first end through said second end and preventing movement in a direction from said second end through said first end;

a nipple adapted for connection to a hose formed in said shell at said second end of said shell.

6. A commercial roof early warning leak detector as claimed in claim 5 wherein said flange includes a first planar surface and a second planar surface said second planar surface being closer to said second end of said shell than said first planar surface, said second surface having an adhesive thereon.

7. A commercial roof early warning leak detector as claimed in claim 6 wherein said adhesive is waterproof adhesive.

8. A method for clearing ponding water from a roof comprising:

applying a sealant to a water displacement structure;

urging said structure against said roof and displacing water from an area corresponding to said structure;

accessing said roof through said structure; and installing a draining structure within said water displacement structure and through said roof.

* * * * *